US007172111B2

(12) United States Patent
Yoshioka et al.

(10) Patent No.: US 7,172,111 B2
(45) Date of Patent: Feb. 6, 2007

(54) CONNECTING/HOLDING MACHINE OF CASH CONTAINER AND CONNECTING/HOLDING UNIT OF CASH CONTAINER

(75) Inventors: Kazuei Yoshioka, Tokyo (JP); Jun Fujimoto, Tokyo (JP)

(73) Assignee: Aruze Corp., Tokyo (JP)

( * ) Notice: Subject to any disclaimer, the term of this patent is extended or adjusted under 35 U.S.C. 154(b) by 231 days.

(21) Appl. No.: 10/854,150

(22) Filed: May 27, 2004

(65) Prior Publication Data

US 2004/0238614 A1 Dec. 2, 2004

(30) Foreign Application Priority Data

May 28, 2003 (JP) ..... 2003-150579
May 28, 2003 (JP) ..... 2003-150580

(51) Int. Cl.
*G07B 15/00* (2006.01)

(52) U.S. Cl. ..... 232/15; 232/10; 232/16; 109/45; 109/52; 194/350

(58) Field of Classification Search ..... 232/15, 232/16, 1 D; 109/45, 47, 52; 194/350; 463/25, 463/29

See application file for complete search history.

(56) References Cited

U.S. PATENT DOCUMENTS 5,224,579 A * 7/1993 Brown ..... 194/350
5,259,491 A * 11/1993 Ward II ..... 194/350
5,564,545 A 10/1996 Suzuki
5,615,625 A 4/1997 Cassidy et al.
6,014,594 A * 1/2000 Heidel et al. ..... 700/231
6,125,307 A * 9/2000 Heidel et al. ..... 700/232
6,128,550 A * 10/2000 Heidel et al. ..... 700/232
6,289,261 B1 * 9/2001 Heidel et al. ..... 700/231
6,293,867 B1 * 9/2001 Heidel et al. ..... 463/25
2002/0063035 A1 * 5/2002 Blad et al. ..... 194/350
2002/0185531 A1 * 12/2002 Matzig ..... 235/382
2003/0000957 A1 1/2003 Brexel et al.
2004/0033832 A1 * 2/2004 Solomon ..... 463/25
2005/0107167 A1 * 5/2005 Sasaki ..... 463/46

FOREIGN PATENT DOCUMENTS

JP 2002-92700 3/2002

* cited by examiner

*Primary Examiner*—William L. Miller
(74) *Attorney, Agent, or Firm*—Leydig, Voit & Mayer, Ltd.

(57) ABSTRACT

A connecting/holding machine 30 of a cash container according to the present invention holds a cash container 15 having a bottom portion 15*a* and a back face side portion 15*d* and provided with first terminal portions 22 and 23 and a fitting-in hole 47 in its back face side portion 15*d*. This connecting/holding machine 30 includes a holding base 70 in which a mounting portion 40 capable of mounting the cash container 15 and a back face portion 42 standing from the mounting portion 40 are constituted in conformity with an external shape of the cash container 15. The back face portion 42 includes second terminal portions 37 and 38 capable of being connected to the first terminal portions 22 and 23 at positions corresponding to the first terminal portions 22 and 23. The back face portion 42 also includes an engaging protrusion 45 capable of fitting in the fitting-in hole 47 at a position corresponding to the fitting-in hole 47.

13 Claims, 13 Drawing Sheets

CONNECTING/HOLDING SYSTEM 101

CONNECTING/HOLDING MACHINE OF CASH CONTAINER AND CONNECTING/HOLDING UNIT OF CASH CONTAINER

CROSS REFER TO RELATED APPLICATIONS

This application is based upon and claims the benefit of priority from the prior Japanese Patent Application No. 2003-150579, filed on May 28, 2003; 2003-150580, filed on May 28, 2003 the entire contents of which are incorporated herein by reference.

BACKGROUND OF THE INVENTION

1. Field of the Invention

The present invention relates a connecting/holding machine of a cash container constituting a cash handling machine used for a game machine such as a slot machine, a vending machine, and the like (hereinafter referred to as a game machine and the like), and a connecting/holding unit of a cash container.

2. Related Background Art

A cash handling machine and a bill handling machine have heretofore been used in a game machine and the like. For example, Patent Document 1 (Japanese Patent Application Laid-Open No. 8-123991) discloses a cash handling machine comprising a cash discriminator for discriminating the validity of cash sent from a cash insertion slot and a cash container for sequentially receiving the cash discriminated to be valid by the cash discriminator. The cash container in this cash handling machine is constituted so as to be detachable from a main body of the cash handling machine so that the cash accumulated inside can be taken out therefrom, and detached from the main body of the cash handling machine to be transported together with the cash.

Furthermore, Patent Document 2 (Japanese Patent Application Laid-pen No. 2002-92700) discloses a bill handling machine. This bill handling machine has a bill acceptance machine which has a bill recognition machine and is disposed between game machines, a bill payout machine, and a cassette type cashbox detachable from the bill acceptance machine. The cassette type cashbox has storage means capable of storing cashbox discriminating information.

On the other hand, as in the cash container described in the above described Patent Document 1, some of the conventional cash containers use strong materials so that the cash inside the cash container cannot be easily taken out during transporting it, since the cash container can be transported together with the cash. Such kind of cash container has considerable weight, and constituted so as to function as a sort of portable cashbox.

Moreover, in order to prevent the cash therein from being taken out easily during being transported, such kind of cash container is constituted such that an opening/closing lid is automatically locked/unlocked. Motors and solenoids are generally used as power source for locking/unlocking such opening/closing lid. A main body of the cash handling machine and a connecting/holding machine of the cash container to be described later are connected to the power source through a terminal portion for connection, which is provided in the cash container, and power is supplied from its main body and the connecting/holding machine.

Furthermore, in some cases, in order to make it possible afterward to confirm that the cash in the cash container have been lost during the transportation, such kind of cash handling machine recognizes information (cash information) indicating how much cash are accommodated for each kind of cash, by its cash discriminator, and allows the cash container to store this information therein. This cash information is transmitted or communicated to the cash container side from the cash discriminator through terminal portions provided in the main body of the cash handling machine and the cash container, and stored in a nonvolatile memory and the like incorporated in the cash container.

The cash container described above is connected to the connecting/holding machine thereof installed in a cash collection place, whereby the opening/closing lid is unlocked in accordance with an instruction from an information processing machine connected to the connecting/holding machine, and the stored cash information is read out.

SUMMARY OF THE INVENTION

As described above, the cash container having the function as the portable cashbox has considerable weight. Accordingly, if such cash container is erroneously handled when such cash container is attached/detached to/from the connecting/holding machine, there has been a possibility that the terminal portions of the cash container and connecting/holding machine are broken or snapped easily, and there has been a fear that the cash container and the connecting/holding machine can not be connected.

Accordingly, the present invention is made to solve the above described problems, and the objects of the present invention is to prevent terminal portions of a cash container and connecting/holding machine of a cash container from being broken, being snapped and the like, and to making it easy to connect the cash container and the connecting/holding machine.

To solve the above described problems, the present invention provides a connecting/holding machine of a cash container for holding a cash container which has a bottom portion and a side portion and is provided with a first terminal portion in the side portion thereof, which comprises: a holding base having a structure in conformity with an external shape of the cash container and including a second terminal portion capable of being connected to the first terminal portion; and regulation means for regulating a movement of the cash container on the holding base in a connection direction where the first terminal portion comes into connection with the second terminal portion and in a release direction where the connection of the first and second terminal portions is released.

The holding base may further have a guide roller which rotates while supporting the bottom portion of the cash container. Furthermore, the holding base may further have a magnetic portion capable of attracting the side portion of the cash container by magnetic force.

The present invention provides a connecting/holding machine of a cash container for holding a cash container which has a bottom portion and a side portion and is provided with a first terminal portion and a first engaging portion in the side portion of the same, which comprises: a holding base in which a mounting portion capable of mounting the cash container and a back face portion standing from the mounting portion are constituted in conformity with an external shape of the cash container, wherein the back face portion includes a second terminal portion capable of being connected to the first terminal portion at a position corresponding to the first terminal portion, and a second engaging portion capable of fitting in the first engaging portion at a position corresponding to the first engaging portion.

The present invention provides a connecting/holding machine of a cash container for holding a cash container which has a bottom portion and a side portion and is provided with a first terminal portion in the side portion thereof, the connecting/holding machine comprising: a holding base in which a mounting portion capable of mounting the cash container and a back face portion standing from the mounting portion are constituted in conformity with an external shape of the cash container, wherein the mounting portion includes a pair of guide members having a disposal interval corresponding to a width of the bottom portion, and the back face portion includes a second terminal portion capable of being connected to the first terminal portion at a position corresponding to the first terminal portion.

In this case, the mounting portion may preferably include a guide roller which rotates while supporting the bottom portion of the cash container. The back face portion may preferably include a magnetic portion capable of attracting the side portion of the cash container by magnetic force.

Furthermore, the connecting/holding machine may further comprise slanting means for slanting the holding base toward the back face portion from a front side of the mounting portion.

The present invention provides a connecting/holding unit of a cash container, which comprises the cash container having a bottom portion and a side portion and provided with a first terminal portion in the side portion thereof; and a connecting/holding machine of the cash container holding a cash container, wherein the connecting/holding machine comprising: a holding base having a structure in conformity with an external shape of the cash container and having a second terminal portion capable of being connected to the first terminal portion; and regulation means for regulating a movement of the cash container on the holding base in a connection direction where the first terminal portion comes into connection with the second terminal portion and in a release direction where the connection of the first and second terminal portions is released.

The present invention provides a connecting/holding unit of a cash container, which comprises: the cash container having a bottom portion and a side portion and provided with a first terminal portion and a first engaging portion in the side portion thereof; and a connecting/holding machine of the cash container holding a cash container, wherein the connecting/holding machine includes a holding base in which a mounting portion capable of mounting the cash container and a back face portion standing from the mounting portion are constituted in conformity with an external shape of the cash container; and the back face portion includes a second terminal portion capable of being connected to the first terminal portion at a position corresponding to the first terminal portion, and a second engaging portion capable of fitting in the first engaging portion at a position corresponding to the first engaging portion.

The present invention provides a connecting/holding unit of a cash container, which comprises the cash container having a bottom portion and a side portion and provided with a first terminal portion in the side portion thereof; and a connecting/holding machine of a cash container holding a cash container, wherein the connecting/holding machine includes a holding base in which a mounting portion capable of mounting the cash container and a back face portion standing from the mounting portion are constituted in conformity with an external shape of the cash container; and the mounting portion includes a pair of guide members having a disposal interval corresponding to a width of the bottom portion; and the back face portion includes a second terminal portion capable of being connected to the first terminal portion at a position corresponding to the first terminal portion.

According to the present invention, when the cash container is electrically connected to the connecting/holding machine, or when the connection of them is released, it is possible to prevent the terminal portions of the cash container and connecting/holding machine from being broken, being snapped and the like. The connection of the terminal portions in the cash container and the connecting/holding machine can be performed securely.

In the present invention, the "cash" means a medium in a commodity exchange, and is a concept widely including a portable medium used in playing a game by use of a game machine, and in purchasing the commodity. Therefore, the "cash" includes not only a bill and a hard money generally circulating, as a matter of course. In addition the "cash" includes a medal used only in a specific gaming place, a cash-out ticket in which credit information is printed on its surface, and the like. Furthermore, the constitution of the cash container and the constitution of the acceptance slot for accepting the cash described above may be suitably modified in accordance with the used "cash".

The present invention will be more fully understood from the detailed description given hereinbelow and the accompanying drawings which are given by way of illustration only, and thus are not to be considered as limiting the present invention.

DETAILED DESCRIPTION OF THE PREFERRED EMBODIMENTS

Figure 1:
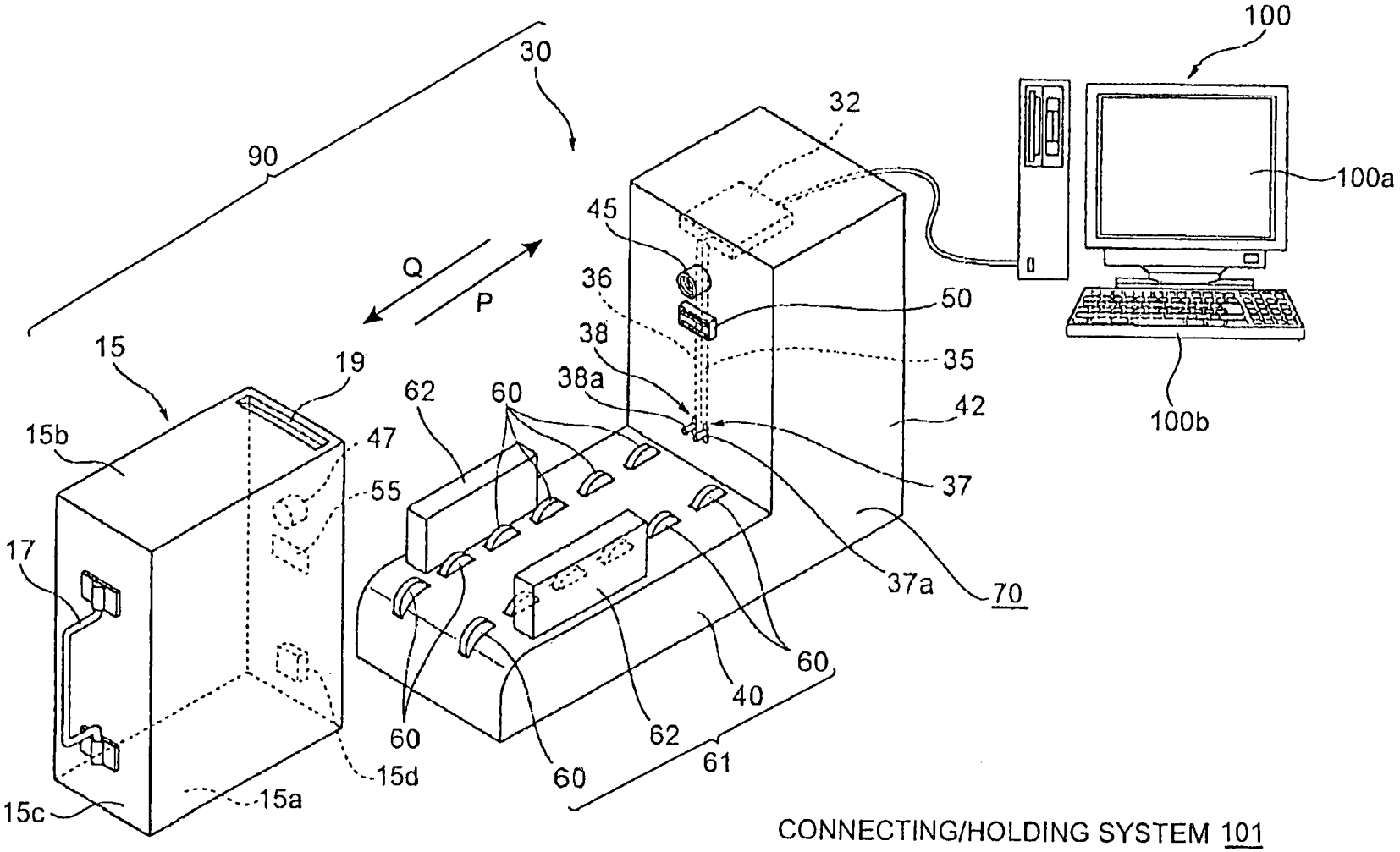
FIG. 1 is a system configuration diagram showing a whole structure of a connecting/holding system of a cash container according to a first embodiment, which has a connecting/holding unit of the cash container and an information processing machine.

Embodiments of a connecting/holding machine of a cash container and a connecting/holding unit of a cash container according to the present invention will be described below referring to the attached drawings. It is noted that the same components are denoted by the same reference numerals, and redundant explanations are omitted.

(First Embodiment)

Figure 2:
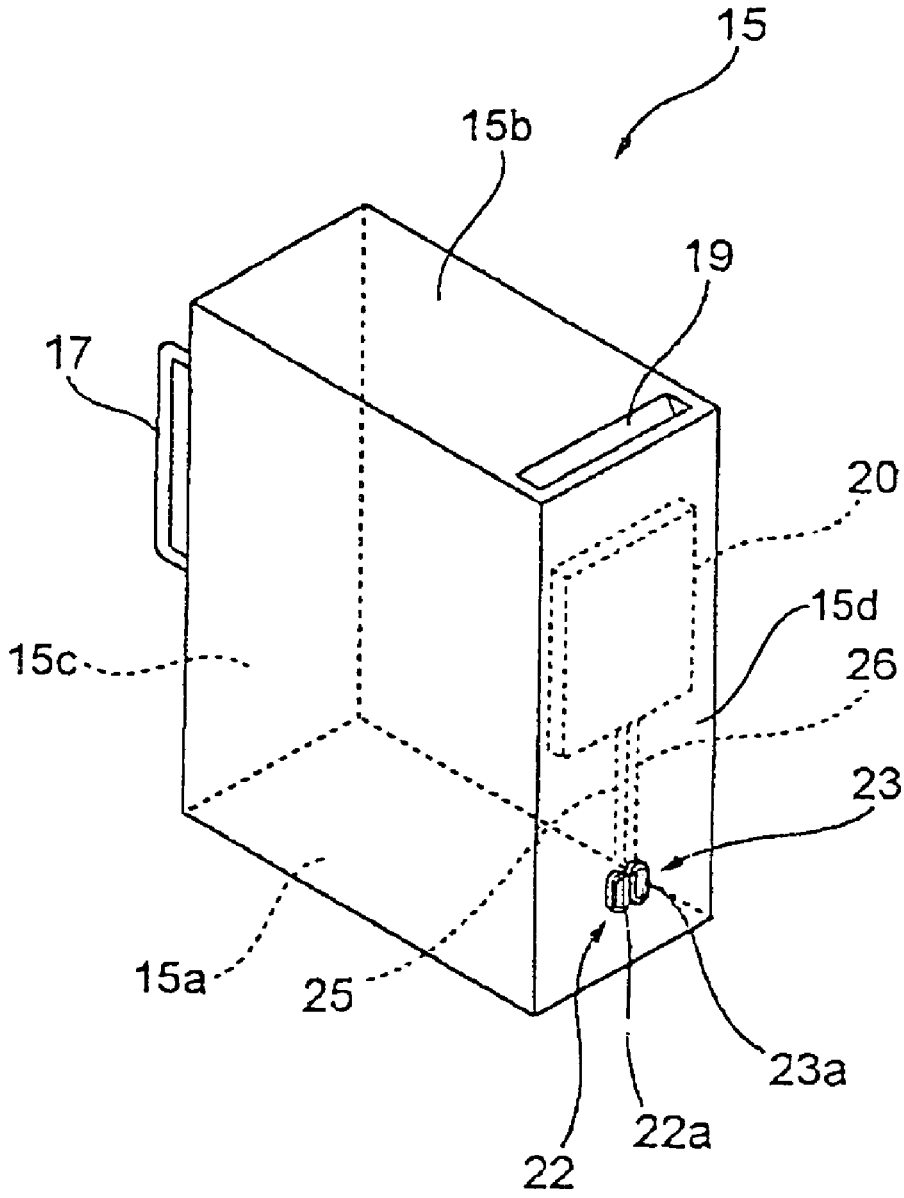
FIG. 2 is a perspective view of the cash container according to the first embodiment, which is viewed from its back face side.
Figure 3:
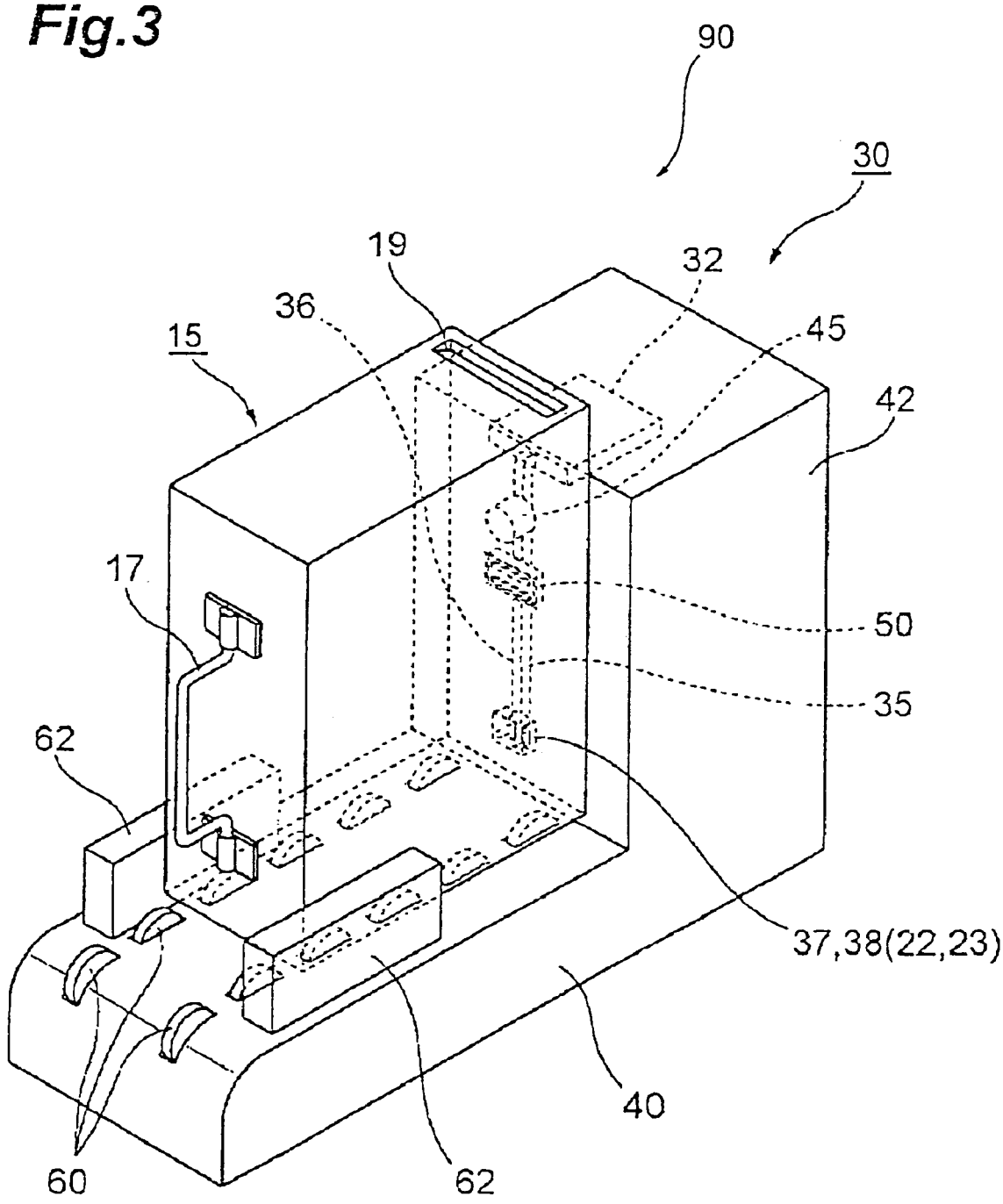
FIG. 3 is a perspective view showing the connecting/holding unit of the cash container when the cash container according to the first embodiment is held by and connected to the connecting/holding machine.

FIG. 1 is a system configuration diagram showing a whole structure of a connecting/holding system 101 of a cash container having a connecting/holding unit 90 of a cash container and an information processing machine 100 according to the present invention. FIG. 2 is a perspective view of the cash container 15 viewed from its back face side, which constitutes the connecting/holding unit 90 of the cash container. FIG. 3 is a perspective view showing the connecting/holding unit 90 of the cash container when the cash container 15 is held by and connected to the connecting/holding machine 30.

The connecting/holding system 101 of a cash container has the connecting/holding unit 90 of a cash container and the information processing machine 100. The connecting/holding unit 90 of a cash container has the cash container 15 and the connecting/holding machine 30 to which the cash container 15 is connected in a state where the cash container 15 is held by the connecting/holding machine 30.

The cash container 15 is formed to a nearly cuboid shape, which has a rectangular bottom portion 15*a*, four side portions and a top portion 15*b*, which are made of metal such as iron. The cash container 15 is adapted to be used as a portable cashbox which is portable in a state where cash is contained therein. The cash container 15 is provided with an opening/closing lid 18 in its bottom portion 15*a* (see FIG. 9), and is constituted so that cash contained therein can be taken out and collected by opening the opening/closing lid 18. In addition, the cash container 15 has a bill accommodation slot 19 in its top portion 15*b*.

Furthermore, the cash container 15 has a handle 17 in its front face side portion 15*c* disposed on its front face side among the four side portions, and has a pair of first terminal portions 22 and 23 in its back face side portion 15*d*, which are disposed on the back face side. The back face side portion 15*d* has a fitting-in hole 47 as a first engaging portion in the present invention. The fitting-in hole 47 is formed by hollowing the back face side portion 15*d* so that the fitting-in hole 47 is matched with an external shape of an engaging protrusion 45 of the connecting/holding machine 30 described later. The back face side portion 15*d* also has a fitting-in hole 55 by hollowing the back face side portion 15*d* so that the fitting-in hole 55 is matched with an external shape of a permanent magnet 50 described later.

Furthermore, a circuit board 20 is provided inside the back face side portion 15*d*. A control circuit is mounted on the circuit board 20. The control circuit has a function of monitoring the cash container 15 such as storing sorts and amounts of bill and coins contained in the cash container 15, numbers of game machines in which the cash container 15 is incorporated, and the like.

The first terminal portions 22 and 23 have ellipse-shaped concaved acceptance portions 22*a* and 23*s* having a bottom portion formed to be a planar shape, and second terminal portions 37 and 38 of the connecting/holding machine 30 described later can come into contact with the respective acceptance portions 22*a* and 23*a*. Furthermore, the first terminal portions 22 and 23 and the circuit board 20 are connected by two power/signal lines 25 and 26 for supplying power and transmitting/receiving signals.

The connecting/holding machine 30 has a holding base 70 having a structure in conformity with an external shape of the cash container 15. The holding base 70 has a mounting portion 40 and a back face portion 42 almost vertical standing from the mounting portion 40. The mounting portion 40 and the back face portion 42 intersect almost perpendicularly to each other, and are constituted so that they correspond to an external shape of a portion including the bottom portion 15*a* and the back face side portion 15*d* in the cash container 15.

The mounting portion 40 serves as a base portion for mounting the cash container 15. The mounting portion 40 has a size larger than that of the bottom portion 15*a* of the cash container 15, and a length longer than a depth dimension of the bottom portion 15*a* toward the back face portion 42 from a front side end portion to which the back face portion 42 is not connected. Furthermore, the mounting portion 40 has guide roller rows 61, 61 disposed with an interval corresponding to a width of the bottom portion 15*a*, and is constituted so as to be slidable while mounting the cash container 15. Each of the guide roller rows 61 has a plurality of rollers 60 (six in the drawing) arrayed in a single row, which are partially exposed at the surface of the mounting portion 40 and rotate while supporting the bottom portion 15*a* of the cash container 15. It is noted that the number of the rollers 60 may be larger than six or smaller than six.

The mounting portion 40 has a pair of guide members 62, 62 having an disposal interval corresponding to the width of the bottom portion 15*a* therebetween. Each of the guide members 62, has a function as regulation means for regulating a movement of the cash container 15 on the holding base 70 in a direction other than a direction P in which the first terminal portions 22 and 23 are connected to second terminal portions 37 and 38 described later (hereinafter referred to as a connection direction) and a direction Q in which their connections are released (hereinafter referred to as a release direction). Specifically, when the cash container 15 moves on the mounting portion 40 while sliding thereon, the cash container 15 moves forward and backward along the connection and release directions P and Q while being guided by the guide members 62. However, the cash container 15 is incapable of moving in the right and left directions (in a lateral direction).

The back face portion 42 has a size large enough to accept the back face side portion 15*d*. Moreover, the back face portion 42 has a height slightly lower than that of the back face side portion 15*d* and a width slightly wider than that of the back face side portion 15*d*. Still furthermore, the back face portion 42 has the pair of second terminal portions 37 and 38, the engaging protrusion 45 and the permanent magnet 50 on a side portion (the front side), which is capable of contacting with the back face side portion 15*d* of the cash container 15.

The second terminal portions 37 and 38 are disposed at positions corresponding to the first terminal portions 22 and 23 of the cash container 15, respectively, and are configured to be connectable with the first terminal portions 22 and 23 thereof. The second terminal portions 37 and 38 are made of an electrically conductive material, and have rod-like protrusions 37*a* and 38*a* which protrude almost parallel along the mounting portion 40 from the surface of the back face portion 42. The rod-like protrusions 37*a* and 38*a* are fitted in the respective concaved acceptance portions 22*a* and 23*a* of the first terminal portions 22 and 23, and thus the first terminal portions 22 and 23 and the second terminal portions 37 and 38 are connected to each other.

The engaging protrusion 45 is a second engaging portion in the present invention, and protrudes from the surface of the back face portion 42 toward the front side. The engaging protrusion 45 can be fitted in the fitting-in hole 47 of the cash container 15, and is disposed at the position corresponding to the fitting-in hole 47. The engaging protrusion 45 has a function as regulation means in the present invention together with the fitting-in hole 47.

The permanent magnet 50 is a magnetic portion in the present invention, and can attract the back face side portion 15*d* of the cash container 15 by its magnetic force. Moreover, the permanent magnet 50 can be fitted in the fitting-in hole 55 of the cash container 15, and is disposed at the position corresponding to the fitting-in hole 55. The permanent magnet 50 also has a function as regulation means in the present invention together with the fitting-in hole 55.

Furthermore, the connecting/holding machine 30 has a function as a relay machine for relaying transmission/reception of information between the cash container 15 and the information processing machine 100 (hereinafter referred to as a relay function). The connecting/holding machine 30 in this embodiment has a function of allowing a control signal transmitted from the information processing machine 100 to be inputted to the cash container 15 in order to unlock the key of the opening/closing lid 18 of the cash container 15 so that cash contained in the cash container 15 can be collected. The connecting/holding machine 30 also has a function of input, from the cash container 15, cash information indicating contents of the cash contained in the cash container 15 and transmitting the cash information to the information processing machine 100. With such relay function, when an operator connects the cash container 15 to the connecting/holding machine 30, the cash container 15 is connected to the information processing machine 100 through the connecting/holding machine 30. Accordingly, the following things become possible. For example, a display machine 100*a* of the information processing machine 100 is allowed to display the cash information indicating the contents of the cash contained in the cash container 15, and hence the operator can confirm the contents of the cash contained in the cash container 15. Furthermore, the operator operates an input machine 100*b* of the information processing machine 100 to allow the information processing machine 100 to transmit the control signal to the cash container 15, and hence the operator can unlock the key of the opening/closing lid 18 to collect the cash.

To realize the relay function, the connecting/holding machine 30 incorporates a control circuit board 32 connected to the information processing machine 100 through a USB connection terminal and the like. A control circuit is mounted on the control circuit board 32, which realizes functions of, for example, receiving the control signal from the information processing machine 100 to supply it to the cash container 15, while receiving the cash information from the cash container 15 to transmit it to the information processing machine 100. By transmitting the control signal to the connecting/holding machine 30 from the information processing machine 100, it is made possible to control driving and stopping of an actuator such as a solenoid and a motor for opening/closing the opening/closing lid 18.

Two power/signal lines 35 and 36 in which power supply and signal transmitting/receiving are performed are connected to the control circuit board 32. The second terminal portions 37 and 38 described above are connected to the ends of the power/signal lines 35, 36, respectively.

Since the cash container 15 and the connecting/holding machine 30 have the above described structures, the first and second terminal portions 22, 23, 37 and 38 are prevented from being broken, being snapped not only when the cash container 15 and the connecting/holding machine 30 are connected to each other in a state where the cash container 15 is mounted on the connecting/holding machine 30 but also when the cash container 15 is detached from the connecting/holding machine 30.

In other words, when the first terminal portions 22 and 23 are connected to the second terminal portions 37 and 38 while mounting (the bottom portion 15*a* of) the cash container 15 on the mounting portion 40 of the holding base 70, the connection of them can be easily performed by two-point connection.

Then, when the back face side portion 15*d* of the cash container come into contact with the back face portion 42, the first and second terminal portions 22, 23, 37 and 38 are connected to each other, and the engaging protrusion 45 is fitted in the fitting-in hole 47. Thus, the cash container 15 is held by and connected to the connecting/holding machine 30. Thus, when the cash container 15 is held by and connected to the connecting/holding machine 30 as shown in FIG. 3, the movement of the cash container 15 is permitted only in the connection direction P or in the release direction Q, and a state where the movement of the cash container 15 is regulated in any of the up-and-down directions and the right-and-left directions is maintained.

Because the movement of the cash container 15 in the directions other than the connection and release directions P and Q is regulated even when the connection state of the first terminal portions 22 and 23 and the second terminal portions 37 and 38 is released, a situation is never created, in which rod-like protrusions 37*a* and 38*a* fitted in the concaved acceptance portions 22*a* and 23*a* shift in a direction other than the release direction Q so that the protrusions 37*a* and 38*a* are pressed against an internal wall of the concaved acceptance portions 22*a* and 23*a*. Therefore, it is possible to effectively prevent the first and second terminal portions 22, 23, 37 and 38 from being broken and snapped. In addition, since the rod-like protrusions 37*a* and 38*a* are pushed toward the front side by an elastic member provided in the second terminal portions 37 and 38, the good connection state of the first terminal portions 22 and 23 and second terminal portions 37 and 38 is securely maintained. Accordingly, it is possible to prevent occurrence of an electrical short-circuit between the cash container 15 and the connecting/holding machine 30.

Furthermore, since back face portion 42 and the back face side portion 15*d* have the engaging protrusion 45 and the fitting-in hole 47, the movement of the cash container 15 is regulated also by the fitting of the engaging protrusion 45 in the fitting-in hole 47, and the connections of the terminal portions can be surely maintained.

The engaging protrusion 45 having the function as the regulation means should preferably formed long toward the release direction Q parallel to the rod-like protrusions 37*a* and 38*a*. With such a structure, until the connection of the rod-like protrusions 37*a* and 38*a* with the concaved acceptance portions 22*a* and 23*a* comes to be released completely, the state where the movement of the cash container 15 in a direction other than the connection and release directions P and Q is regulated is kept. Therefore, it is made possible to prevent the first and second terminal portions 22, 23, 37 and 38 from being broken, being snapped more surely. As a matter of course, also when the first terminal portions 22 and 23 and the second terminal portions 37 and 38 are connected to each other, it is made possible to prevent the first and second terminal portions 22, 23, 37 and 38 from being broken, snapped more surely, since the cash container 15 is guided along the connection direction P by the guide member 62 having the function as the regulation means.

Moreover, since the back face portion 42 of the connecting/holding machine 30 has the permanent magnet 50, the permanent magnet 50 acts so as to attract the cash container 15 by its magnetic force. Therefore, when the first terminal portions 22 and 23 of the cash container 15 and the second terminal portions 37 and 38 of the connecting/holding machine 30 are connected to each other, the sure connection of both of the first and second terminal portions 22, 23, 37 and 38 can be achieved with the aid of the magnetic force. Furthermore, since the cash container 15 has the fitting-in hole 55 corresponding to the permanent magnet 50, the cash container 15 cannot be lifted or displaced in an arbitrary direction in the state of the connection of the cash container 15 and the connecting/holding machine 30 by the fitting of the permanent magnet 50 in the fitting-in hole 55, and the direction of the movement which is permitted for the cash container 15 is regulated. Therefore, it is made possible to more surely prevent the first and second terminal portions 22, 23, 37 and 38 from being broken, snapped and the like while surely keeping the connection of the term portions 22, 23, 37 and 38.

In addition, since the mounting portion 40 has the guide roller rows 61, it is made possible to easily allow the cash container 15, which is heavy, to move slidingly from the front side toward the connecting/holding machine 30 side. Therefore, when the cash container 15 and the connecting/holding machine 30 are connected to each other, or when the connection of them is released, it is made possible to achieve a stable connection without applying large external force particularly.

The above described cash container 15 and the connecting/holding machine 30 may have the following structures.

Figure 4:
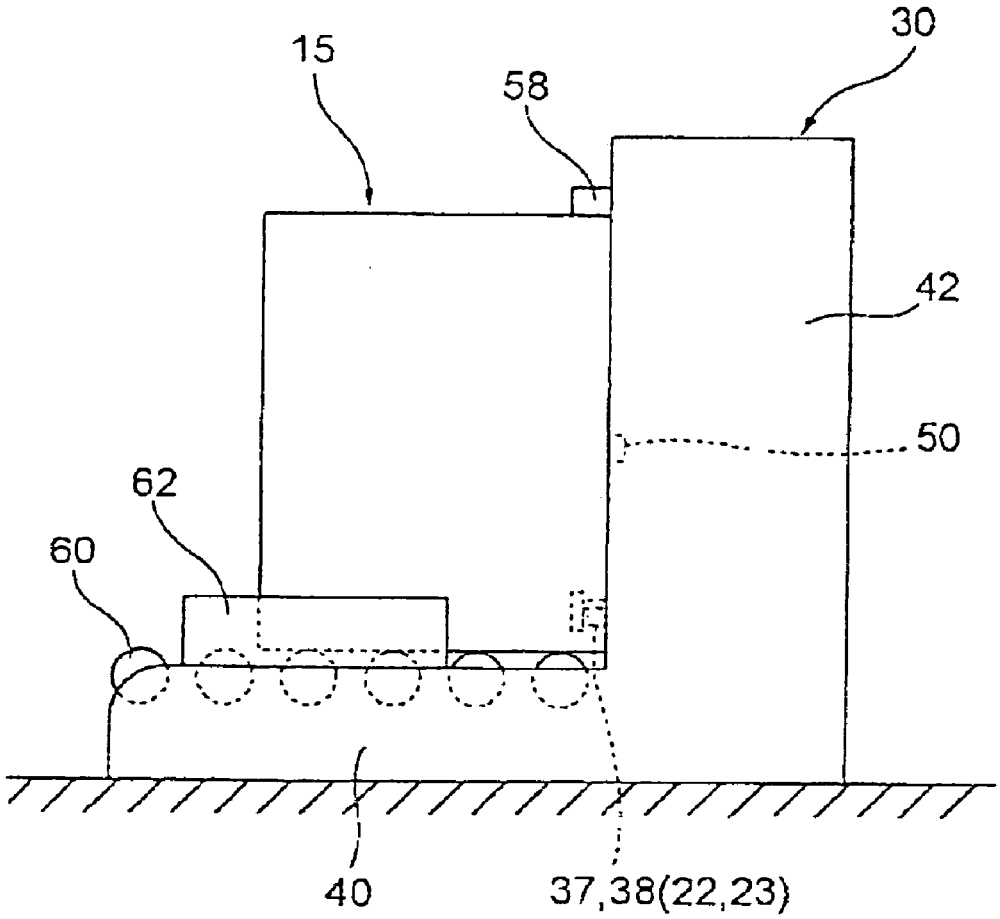
FIG. 4 is a side view of a modification of the connecting/holding unit according to the first embodiment.

For example, in the cash container 15 and the connecting/holding machine 30, the fitting-in holes 47 and 55, the engaging protrusion 45, and the permanent magnet 50 may be interchanged. Specifically, it is possible that the cash container 15 is provided with the engaging protrusion 45 and the permanent magnet 50, while the connecting/holding machine 30 is provided with the fitting-in holes 47 and 55. In either case, the permanent magnet 50 may be provided so that it does not protrude from the surface of the back face portion 42 as shown in FIG. 4. Though the permanent magnet 50 has the function as the magnetic portion, the permanent magnet 50 may not have the function as the regulation member.

With respect to the first terminal portions 22 and 23 and the second terminal portions 37 and 38, the former are formed to be concaved, and the latter is formed to be protrusive. Alternatively, the former may be formed to be protrusive, and the latter may be formed to be concaved. Although the first and second terminal portions are connected to each other in the manner of the two-point connection in order to facilitate the connection, it is satisfactory that the first and second terminal portions can be connected at all events. The concrete structures of them nay be ones other than the above.

A step portion and a projection portion (not shown) may be formed in the back face portion 42, and a concave portion capable of engaging with the step portion or the projection portion may be formed in the cash container 15. Alternatively, the step portion and the projection portion may be formed in the cash container 15, and the concave portion may be formed in the back face portion 42. In any case, the holding base 70 has a structure that corresponds to the external shape of the cash container 15.

As shown in FIG. 4, a regulating protrusion portion 58, which is capable of regulating the upward movement of the cash container 15 or in some cases capable of regulating the movement thereof in the left and right directions, may be provided so as to be in contact with the upper surface of the cash container 15 in a state of being connected to the back face portion 42. The regulating protrusion portion 58 is preferably formed to be longer along the connection direction P than the rod-like protrusions 37*a* and 38*a*.

Without providing the guide roller row 61 in the mounting portion 40, the surface of the back face portion 42 may be formed of a material having a low frictional coefficient.

(Second Embodiment)

A second embodiment of the connecting/holding machine of the cash container and the connecting/holding unit of the cash container according to the present invention will be described with reference to the accompanying drawings. It is noted that in the following descriptions, the same components exhibiting with the cash container 15 and the connecting/holding machine 30 in the first embodiment will be denoted by the same reference numerals, and explanations for them are omitted.

Figure 5:
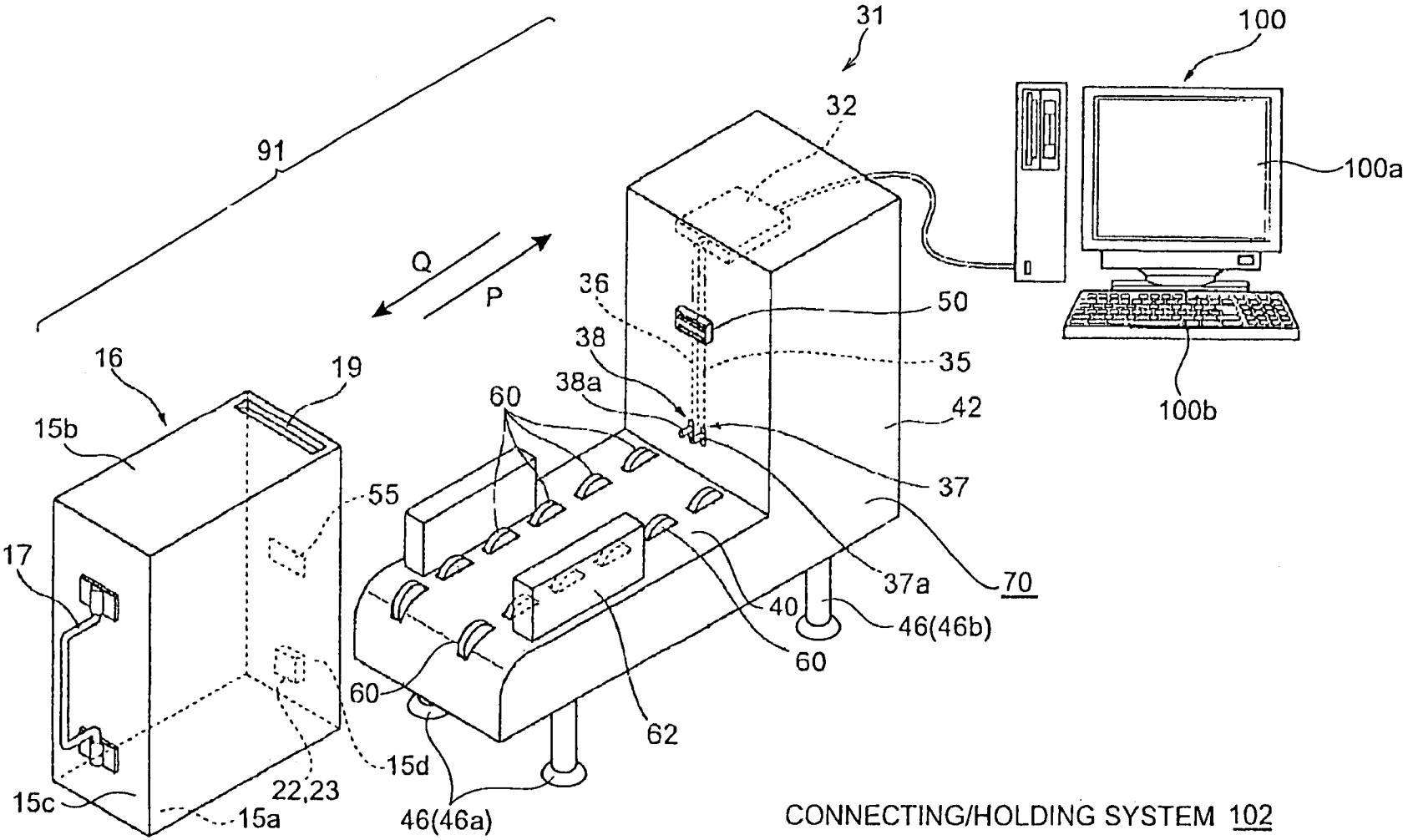
FIG. 5 is a system configuration diagram showing a whole structure of a connecting/holding system of a cash container according to a second embodiment, which has a connecting/holding unit of the cash container and an information processing machine.
Figure 6:
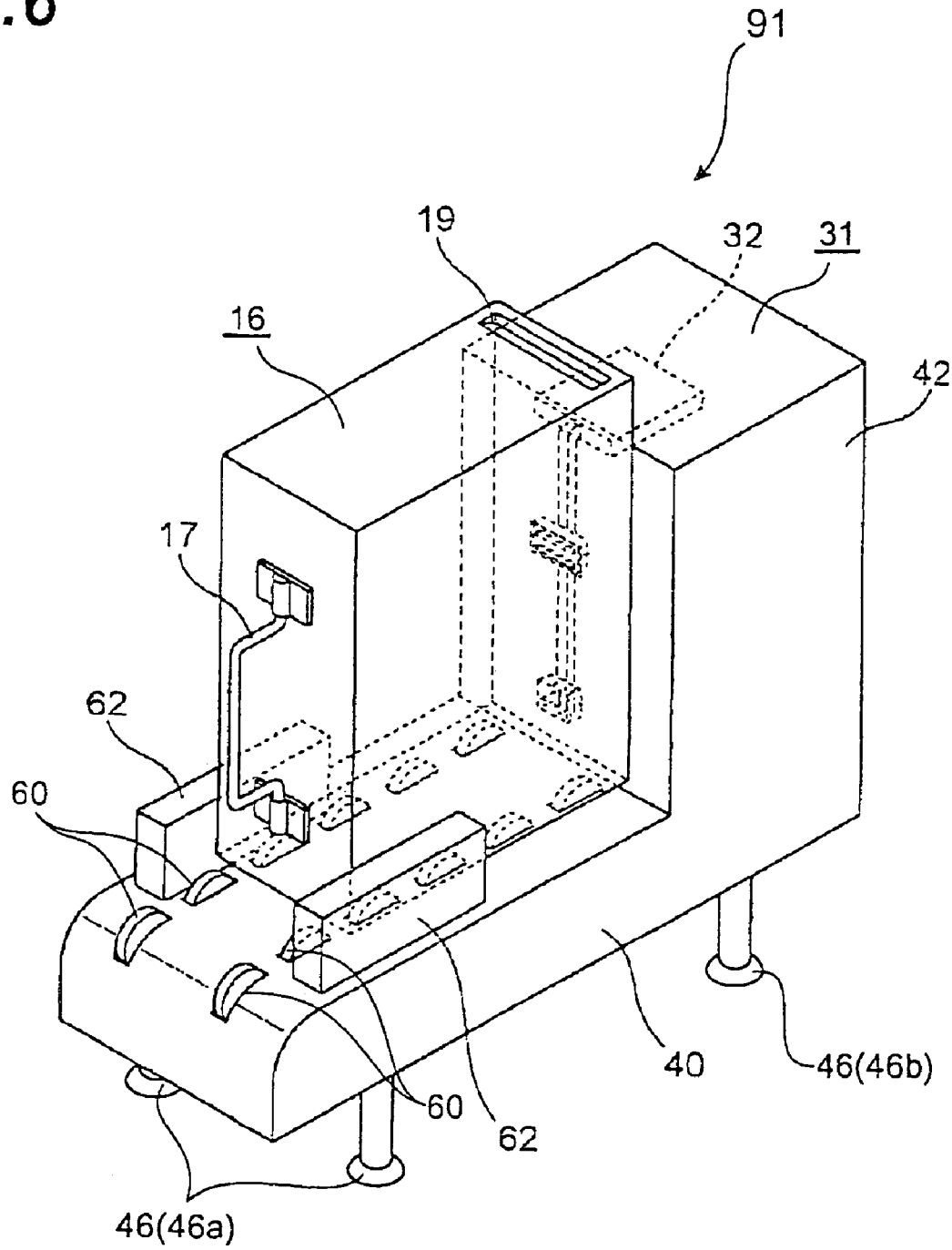
FIG. 6 is a perspective view showing the connecting/holding unit of the cash container when the cash container according to the second embodiment is held by and connected to the connecting/holding machine.
Figure 7:
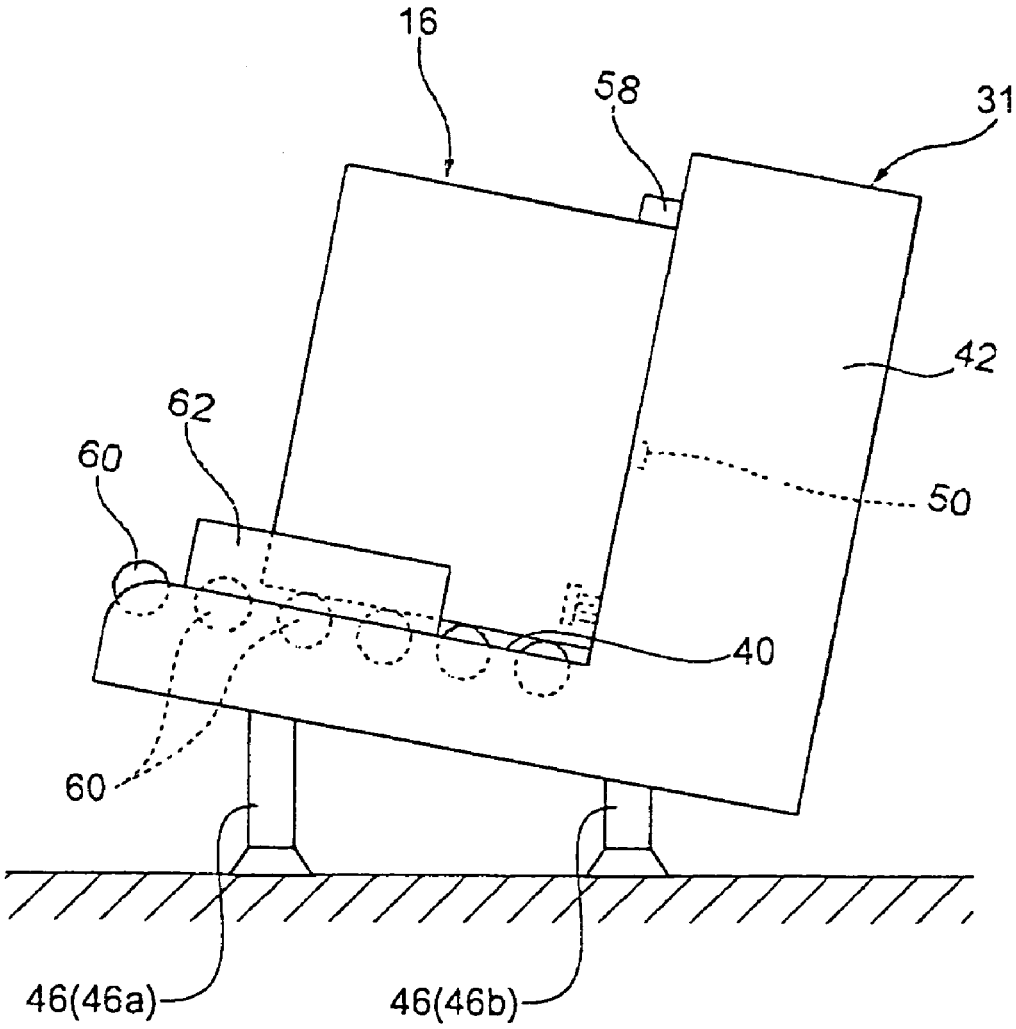
FIG. 7 is a side view of a modification of the connecting/holding unit according to the second embodiment.

FIG. 5 is a system configuration diagram showing a whole structure of a connecting/holding system 102 of a cash container having a connecting/holding unit 91 of a cash container and an information processing machine 100 according to the second embodiment. FIG. 6 is a perspective view showing the connecting/holding unit 91 of a cash container when the cash container 16 is held by and connected to the connecting/holding machine 31. FIG. 7 is a side view showing a modification of the connecting/holding unit 91.

The connecting/holding system 102 of the cash container has the connecting/holding unit 91 of a cash container and the information processing machine 100. The connecting/holding unit 91 of a cash container has the cash container 16 and the connecting/holding machine 31 to which the cash container 16 is connected in a state where the cash container 16 is held by the connecting/holding machine 31.

The cash container 16 differs from the cash container 15 in that it does not have the fitting-in hole 47, and is identical to the cash container 15 in other respects.

The connecting/holding machine 31 differs from the connecting/holding machine 30 in that it does not have the engaging protrusion 45 and has a leg portion 46, and is identical to the connecting/holding machine 30 in other respects.

The leg portion 46 is slanting means in the present invention, and has two front leg portions 46*a* and two rear leg portions 46*b*, which are disposed at the four corners of the bottom surface of the mounting portion 40. The front and rear leg portions 46*a* and 46*b* are used when the connecting/ holding machine 31 is installed on a floor. The front and rear leg portions 46*a* and 46*b* have different lengths, and the rear leg portions 46*b* disposed on the back face portion side are shorter than the front leg portions 46*a* disposed on the front side (the opposite to the back face portion side). The connecting/holding machine 31 slants to the back face portion side in the descending direction to the back face portion side from the front side by the front and rear leg portions 46*a* and 46*b*.

In the connecting/holding machine 31, since the mounting portion 40 slants in the descending direction to the back face portion side from the front side by the leg portion 46, the cash container 16 moves to the back face portion side from the front side while being guided by the guide roller rows 61 and 61, after the cash container 16 is mounted on the mounting portion 40. Also in the case of the connecting/holding unit 90 of the cash container in the first embodiment, the cash container 15 moves to the back face portion side from the front side while being guide by the guide roller rows 61 and 61. However, in the case of the connecting/holding unit 91 of the cash container in this embodiment, since the mounting portion 40 of the connecting/holding machine 31 slants in the descending direction to the back face portion side from the front side, the cash container 16 moves to the back face portion side from the front side upon receipt of the action of gravity due to its self weight. Accordingly, the cash container 16 can be connected to the connecting/holding machine 31 more simply than the cash container 15.

In this case, though the cash container 16 does not have the fitting-in hole 47, the cash container 16 has the fitting-in hole 55. Accordingly, the movement of the cash container 16 on the mounting-portion 40 is regulated by fitting the permanent magnet 50 of the connecting/holding machine 31 in the fitting-in hole 55. Furthermore, since the connecting/holding machine 31 has the guide members 62 and 62, the movement of the cash container 16 on the mounting portion 40 is regulated also by the guide members 62 and 62. Therefore, when the connecting/holding machine 31 is connected to the cash container 16 while mounting the cash container 16, and/or when the cash container 16 is detached from the connecting/holding machine 31, the first and second terminal portions 22, 23, 37 and 38 are not broken or snapped.

Although the length of leg portion 46 is fixedly determined, it may be adapted to be adjustable for length. With adjustable length thereof, a slanting angle of the mounting portion 40 can be adjusted. Furthermore, only the front leg portion 46*a* may be provided without providing the rear leg portion 46*b*. In addition, instead of the provision of the leg portion 46, an openable/closable plate-shaped member may be provided. In addition to this, a bottom portion of the mounting portion 40 may be slanted.

Other operations and effects of the connecting/holding unit 91 are the same as those of the connecting/holding unit 90 of the cash container in the first embodiment, and detailed descriptions for them are omitted.

Figure 8:
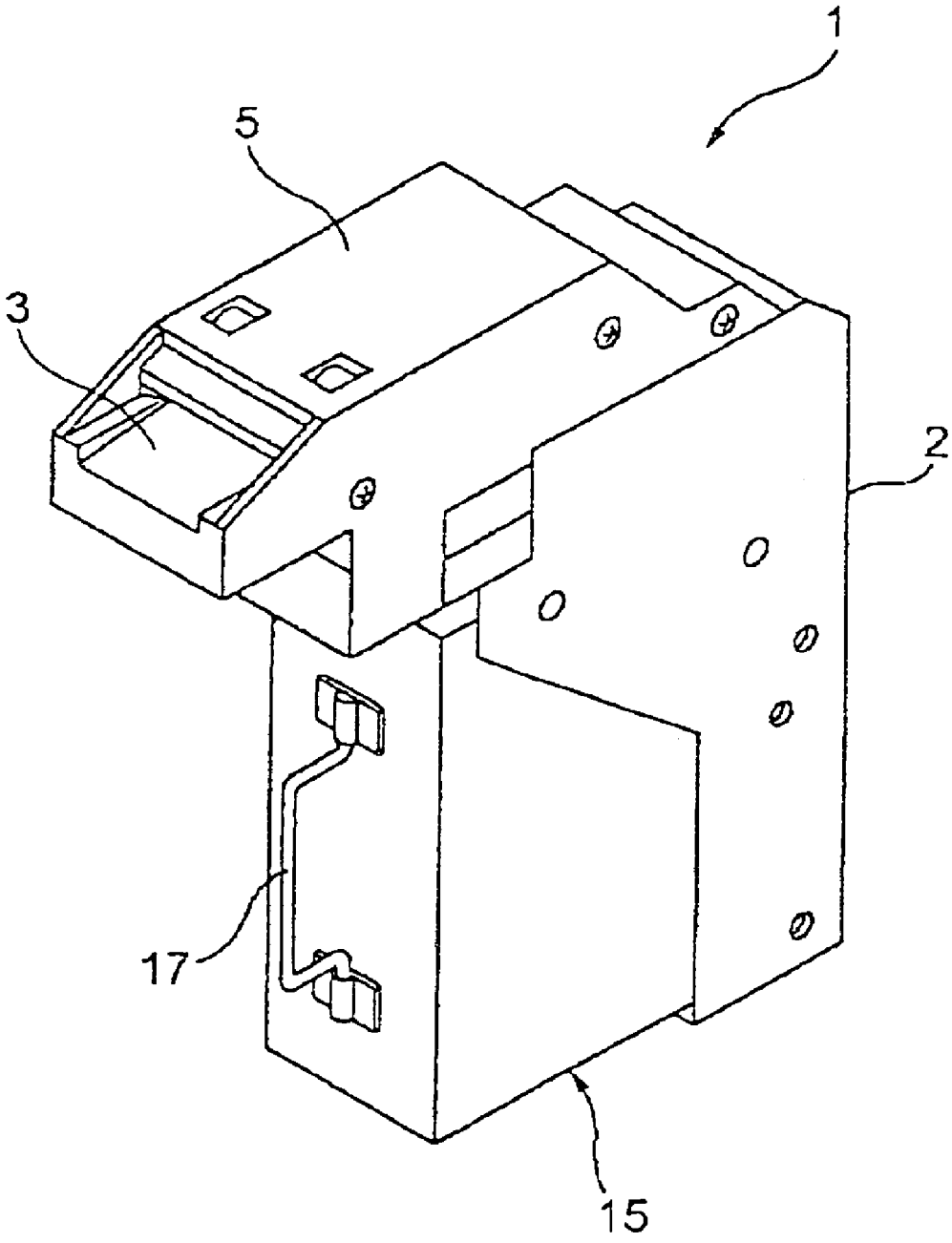
FIG. 8 is a perspective view showing a cash handling machine relating to the present invention.
Figure 9:
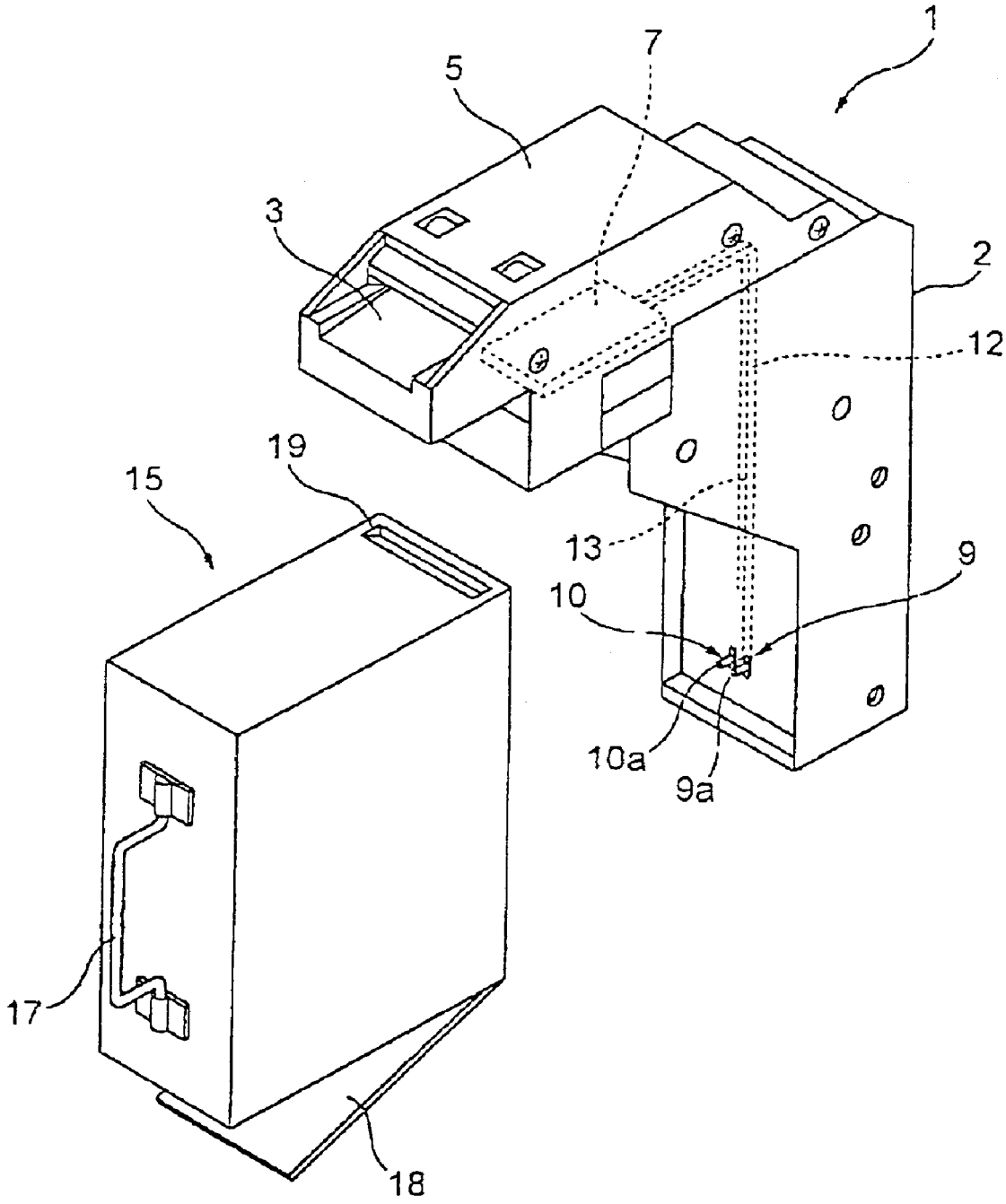
FIG. 9 is an exploded perspective view showing the cash handling machine relating to the present invention.
Figure 10:
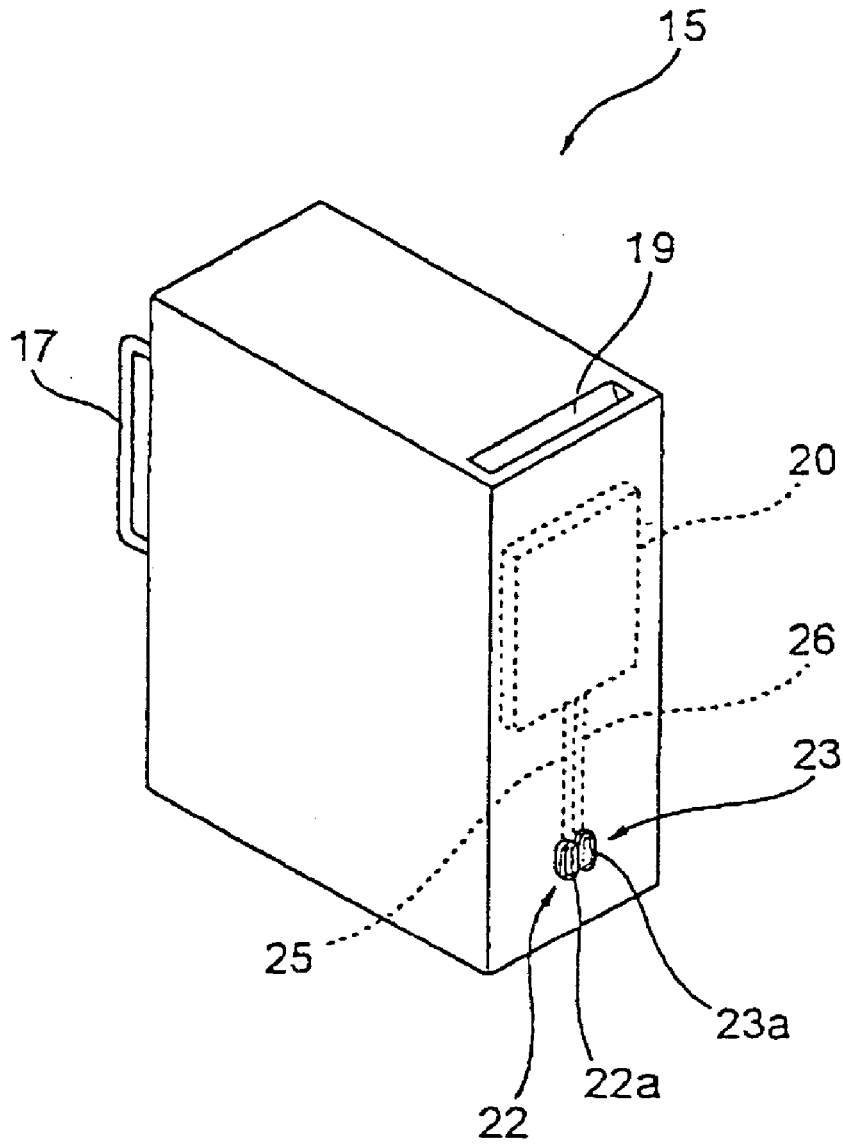
FIG. 10 is a perspective view showing a constitution of the cash container.
Figure 11:
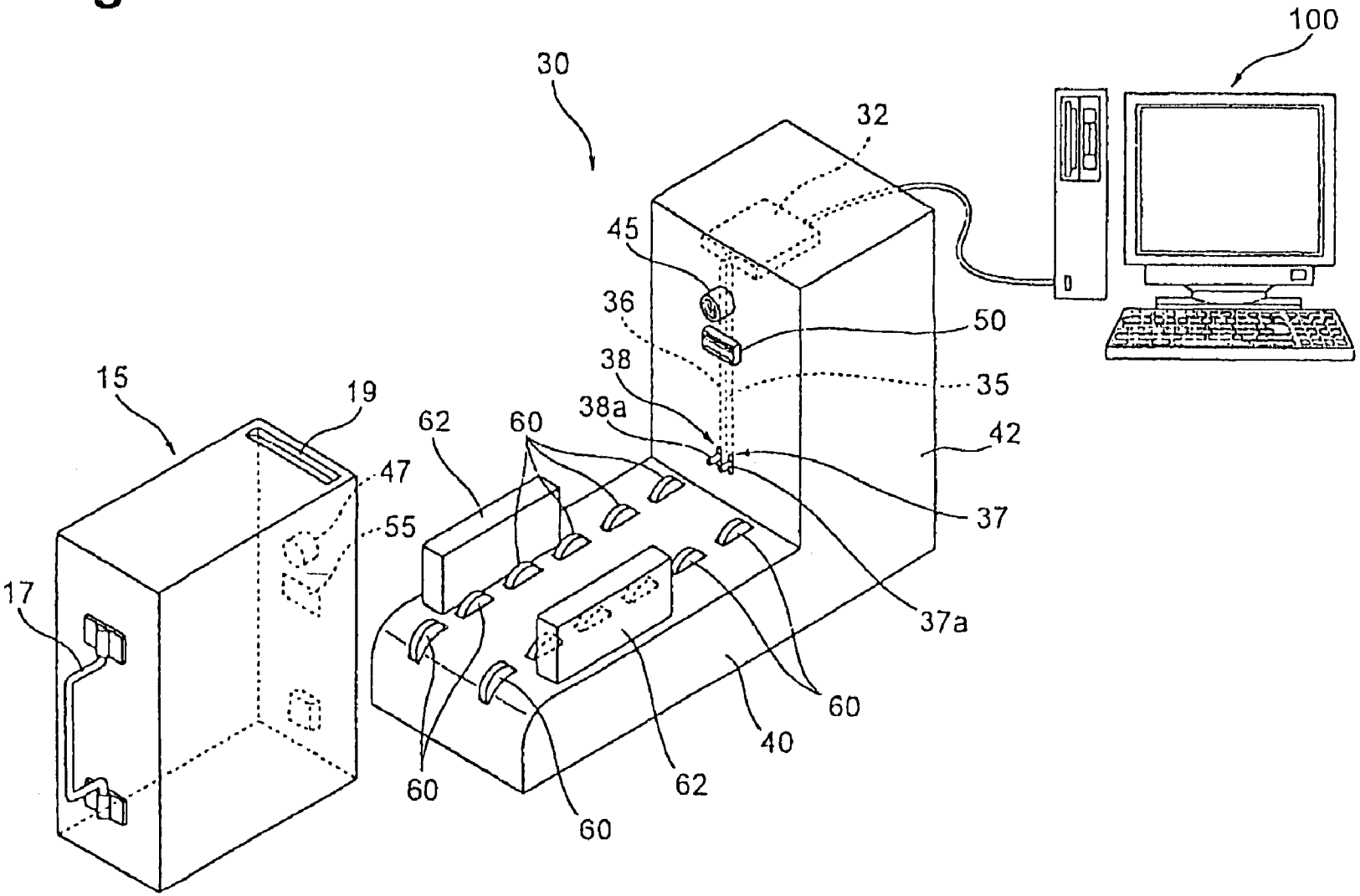
FIG. 11 is a perspective view showing a constitution of the cash container according to the first embodiment, when the cash container is detached from the cash handling machine, and a constitution of the connecting/holding machine to which the cash container is connected.
Figure 12:
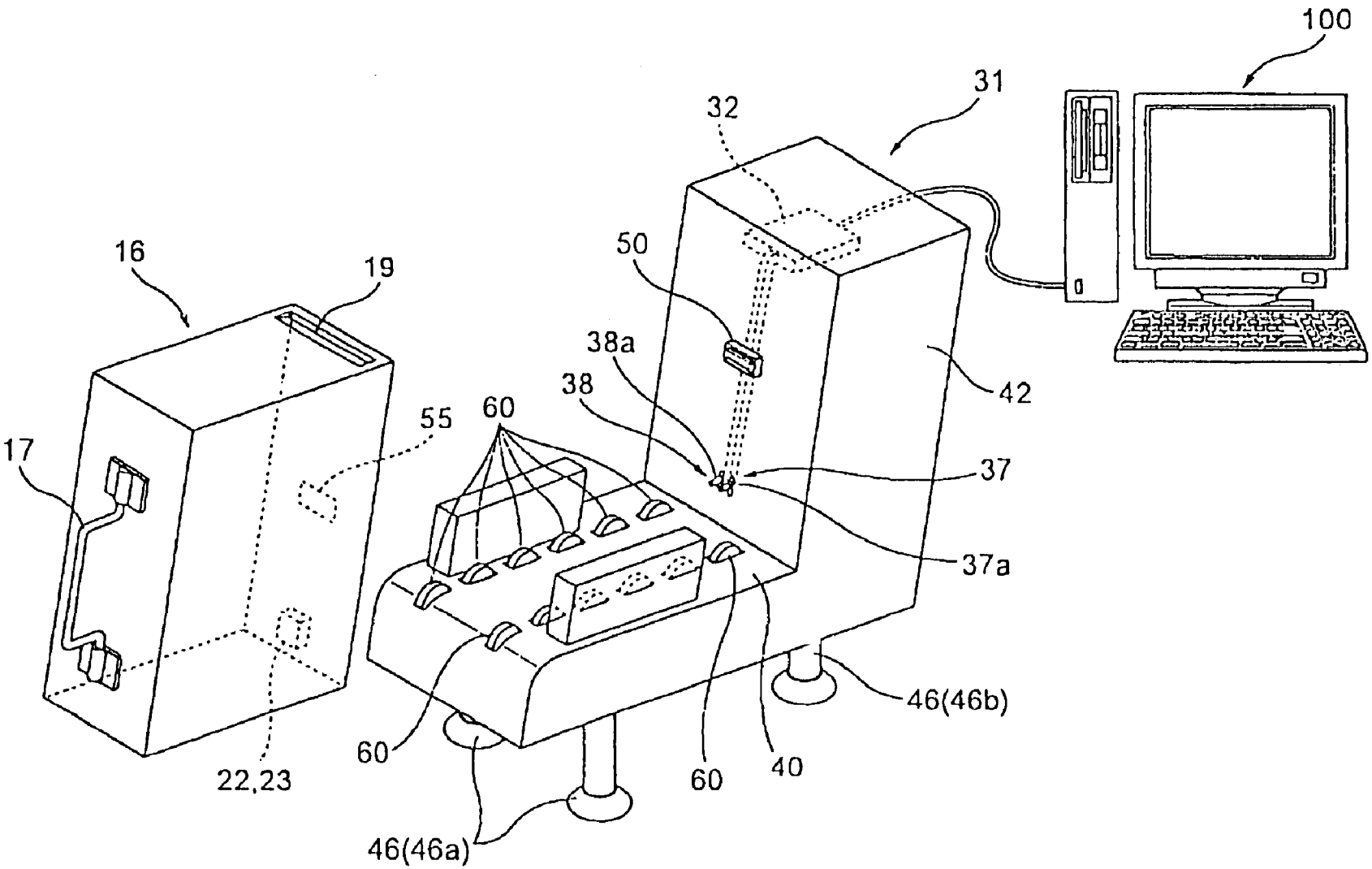
FIG. 12 is a perspective view showing a constitution of the cash container according to the second embodiment, when the cash container is detached from the cash handling machine, and a constitution of the connecting/holding machine to which the cash container is connected.

Next, a cash handling machine relating to the present invention will be described with reference to FIGS. 8 and 9. FIG. 8 is a perspective view showing a cash handling machine 1 relating to the present invention. FIG. 9 is an exploded perspective view of the cash handling machine shown in FIG. 8.

The cash handling machine 1 is incorporated in game machines such as a slot machine 200 described later, vending machines and the like to be used. The cash handling machine 1 has a main body 2 and the above described cash container 15. The main body 2 has a bill acceptance slot 3 for accepting bills as the cash, and a bill discriminator 5 for discriminating the validity of bills inserted from the bill acceptance slot 3. The bill discriminator 5 incorporates a circuit board 7 used for a bill discrimination control. A control circuit is implemented on the circuit board 7. The control circuit has functions of, for example, controlling the driving of a motor for transporting a bill, of performing a judgment of the validity of the bill, in which a signal from a sensor for discriminating the bill is detected to judge the authenticity of the bill, and of transmitting a signal to the cash container 15.

The main body 2 has a pair of terminal portions 9 and 10. Each of the terminal portions 9 and 10 and the circuit board 7 are connected to each other by two power/signal lines 12 and 13 for performing power supply and signal transmitting/receiving. The terminal portions 9 and 10 are formed as a pushing connection type so that the terminal portions 9 and 10 come easily and surely into contact with the first terminal portions 22 and 23 of the cash container 15. The terminal portions 9 and 10 are made of an electrically conductive material, and have rod-like protrusions 9*a* and 10*a* protruding from the surface of the main body by elastic members (not shown).

The above described cash container 15 is freely detachable from the main body 2. The cash container 15 is constituted to stock bills which are inserted in the bill acceptance slot 3 and pass through the bill accommodation slot 19 after being judged to be valid in the bill discriminator 5.

Figure 13:
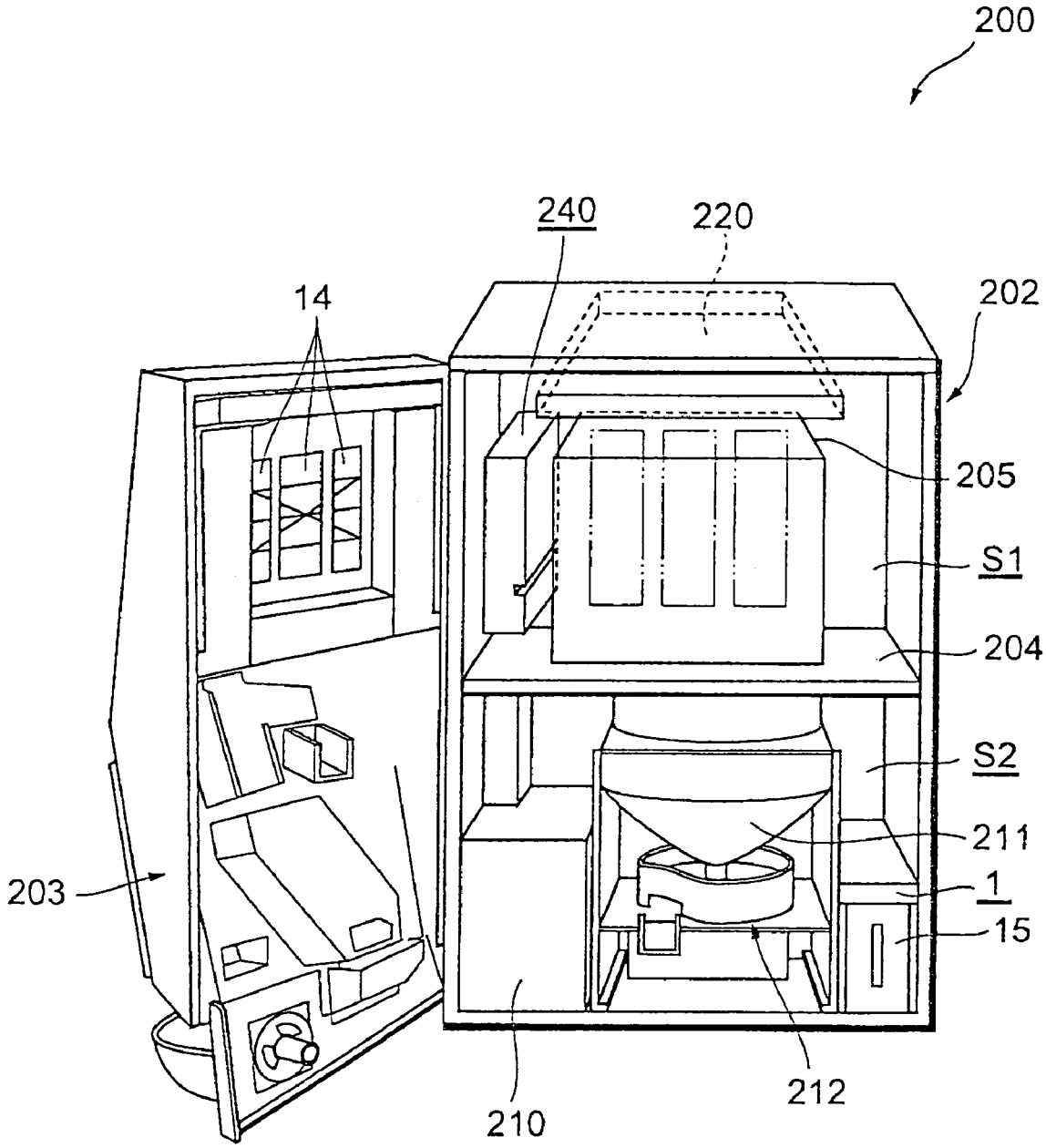
FIG. 13 is a front view showing a slot machine when a door thereof is in opening state.

The cash handling machine 1 is incorporated, for example, in a cabinet 202 of the slot machine 200 to be used, as shown in FIG. 13. FIG. 13 is a front view showing a state where a hinged door of the slot machine 200 incorporating the cash handling machine 1 is opened.

The slot machine 200 has the cabinet 202, and the cabinet 202 has a front door 203 fitted thereon so as to be freely openable by hinges (not shown). The cabinet 202 is fabricated by assembling metal plates, and has a metallic middle plate 204 provided therein so that the interior thereof is divided into an upper region S1 and a lower region S2 (divided horizontally).

The slot machine 200 incorporates, in its upper region S1, a reel unit 205 having three mechanical reels and a drive unit for driving these mechanical reels, a control machine 240 for use in a game machine for performing processing which indirectly relates to games, and a control machine 220 for use in the game machine for performing processing which directly relates to the games.

On the other hand, a power supply unit 210 for supplying power necessary to operate the slot machine 200 is installed in the lower region S2 of the slot machine 200. A bucket 211 and a hopper 212, which gather gaming media such as medals and hard money used in the games (hereinafter referred to as coins) toward a lower position, are installed in the lower region S2 so as to be adjacent to the power supply unit 210. A cash handing machine 1 is installed in their right neighbor on the right.

Bills and hard money dropped by a player to play games in the slot machine 200 are stocked in the cash handling machine 1.

On the other hand, a worker of a game place opens the front door 203 of the slot machine 200, and takes out the cash container 15 from the cash handling machine 1. Then, the worker mounts another empty cash container 15 to interchange them with each other. The worker of the game place takes out the cash containers 15 from other game machines including slot machines 200 installed in the game place in accordance with similar procedures, and performs a collection work for the cash container.

Since the above described connecting/holding machine 30 is installed a cash collection place, the worker of the game place gathers the cash containers 15 in the collection place. Then, the worker of the game place mounts the cash container 15 on the connecting/holding machine 30, and connects the first terminal portions 22 and 23 and the second terminal portions 37 and 38 to each other. Then, the worker allows the information processing machine 100 to transmit the control signal, and reads cash information stored in the cash container 15. The worker then unlocks the key of the opening/closing lid 18, and performs the collection work of the cash stocked in the cash container 15.

It is apparent that various embodiments and modifications of the present invention can be embodied, based on the above description. Accordingly, it is possible to carry out the present invention in the other modes than the above best mode, within the following scope of claims and the scope of equivalents.

What is claimed is:

1. A connecting/holding machine for holding a cash container which has a bottom and a side and includes a first terminal in the side said connecting/holding machine, comprising a holding base having a structure conforming to an external shape of the cash container and including:

a second terminal for connection to the first terminal, and regulation means limiting movement of the cash container on said holding base when the first terminal is connected to said second terminal, the movement limited to a connection direction along which the first terminal comes into connection with said second terminal and a release direction along which connection of the first terminal and said second terminal is released said regulation means comprising a protrusion projecting from one of the side of the cash container and said holding base and a hole, complementary to said protrusion, and located in the other of the side of the cash container and said holding base.

2. The connecting/holding machine according to claim 1, wherein said holding base further includes a guide roller which rotates while supporting the bottom of the cash container.

3. The connecting/holding machine according to claim 1, wherein said holding base further includes a magnetic portion for attracting the side of the cash container by magnetic force.

4. A connecting/holding machine for holding a cash container which has a bottom and a side and includes a first terminal and a first engaging portion in the side, said connecting/holding machine comprising a holding base including a mounting portion for mounting the cash container and a back face extending transverse to and from the mounting portion and conforming to an external shape of the cash container, wherein said back face includes a second terminal for connection to said first terminal at a position corresponding to said first terminal, and a second engaging portion for fitting into the first engaging portion at a position corresponding to the first engaging portion.

5. The connecting/holding machine according to claim 4, wherein said mounting portion further includes a guide roller which rotates while supporting the bottom of the cash container.

6. The connecting/holding machine according to claim 4, wherein said back face further includes a magnetic portion for attracting the side portion of the cash container by magnetic force.

7. A connecting/holding machine for holding a cash container which has a bottom and a side and includes a first terminal in the side, said connecting/holding machine comprising:

a holding base including a mounting portion for mounting the cash container and a back face extending transverse to and from said mounting portion and conforming to an external shape of the cash container, wherein said mounting portion includes a pair of guide members having a separation corresponding to a width of the bottom, and said back face includes a second terminal for connection to the first terminal at a position corresponding to the first terminal; and regulation means limiting movement of the cash container on said holding base when the first terminal is connected to said second terminal, the movement limited to a connection direction along which the first terminal comes into connection with said second terminal and a release direction along which connection of the first terminal and said second terminal is released, said regulation means comprising a protrusion projecting from one of the side of the cash container and said back face and a hole complementary to said protrusion and located in the other of the side of the cash container and said back face.

8. The connecting/holding machine according to claim 7, wherein said mounting portion further includes a guide roller which rotates while supporting the bottom of the cash container.

9. The connecting/holding machine according to claim 7, wherein said back face further includes a magnetic portion for attracting the side portion of the cash container by magnetic force.

10. The connecting/holding machine according to claim 7, further comprising slanting means for slanting said holding base toward said back face from a front side of said mounting portion.

11. A combination comprising:

a cash container having a bottom and a side and including a first terminal in the side; and a connecting/holding machine for holding said cash container, and including a holding base having a structure conforming to an external shape of said cash container and having a second terminal for connection to said first terminal, and regulation means for regulating movement of said cash container on said holding base when said first terminal is connected to said second terminal, the movement limited to a connection direction along which said first terminal comes into connection with said second terminal and a release direction along which connection of said first and second terminals is released , said regulation means comprising a protrusion projecting from one of said side of said cash container and said holding base, and a hole complementary to said protrusion and located in the other of said side of said cash container and said holding base.

12. A combination comprising:

a cash container having a bottom and a side and including a first terminal and a first engaging portion in the side; and a connecting/holding machine for holding said cash container, and including a holding base including a mounting portion for mounting said cash container and a back face extending transverse to and from said mounting portion and conforming to an external shape of said cash container, said back face portion including a second terminal for connection to said first terminal at a position corresponding to said first terminal, and a second engaging portion for fitting in said first engaging portion at a position corresponding to said first engaging portion.

13. A combination comprising:

a cash container having a bottom and a side and including a first terminal in the side; and a connecting/holding machine for holding said cash container, and including a holding base including a mounting portion for mounting said cash container and a back face standing from said mounting portion conforming to an external shape of said cash container, the mounting portion including a pair of guide members having a separation corresponding to a width of said bottom, and said back face includes a second terminal for connection to said first terminal at a position corresponding to said first terminal; and regulation means limiting movement of said cash container on said holding base when said first terminal is connected to said second terminal, the movement limited to a connection direction along which said first terminal comes into connection with said second terminal and a release direction along which connection of said first terminal and said second terminal is released, said regulation means comprising a protrusion projecting from one of said side of said cash container and said back face, and a hole, complementary to said protrusion, and located in the other of said side of said cash container and said back face.

* * * * *